United States Patent [19]

Nitchman et al.

[11] Patent Number: 4,678,101

[45] Date of Patent: Jul. 7, 1987

[54] DISPENSING CONTAINER CLOSURE

[76] Inventors: Harold L. Nitchman, 1230 Parody, St. Charles, Mo. 63301; William B. Cunningham, Jr., 916 Woodshire, Creve Coeur, Mo. 63141

[21] Appl. No.: 759,073

[22] Filed: Jul. 25, 1985

Related U.S. Application Data

[63] Continuation-in-part of Ser. No. 487,561, Apr. 22, 1983, Pat. No. 4,531,656, which is a continuation-in-part of Ser. No. 439,115, Nov. 4, 1982, which is a continuation-in-part of Ser. No. 363,511, Apr. 2, 1982, Pat. No. 4,491,247, which is a continuation-in-part of Ser. No. 285,611, Jul. 21, 1981, Pat. No. 4,440,319.

[51] Int. Cl.[4] ..... B67B 7/24

[52] U.S. Cl. ..... 222/82; 222/86; 222/399; 222/400.7; 222/541

[58] Field of Search ..... 222/80, 82-83, 222/85-86, 89, 479, 541, 547, 562, 400.7, 545, 131, 183, 394, 399, 325

[56] References Cited

U.S. PATENT DOCUMENTS

| | | | |
|---|---|---|---|
| 1,850,877 | 3/1932 | Hogg | 222/85 |
| 2,167,866 | 8/1939 | Bennett | 222/82 X |
| 2,802,696 | 8/1957 | Galeazzi | 222/82 |
| 2,825,334 | 3/1958 | Kas, Sr. | 222/85 X |
| 2,899,106 | 8/1959 | Weinert | 222/82 |
| 3,237,818 | 3/1966 | Bijvoet | 222/545 X |
| 3,352,457 | 11/1967 | Tracy et al. | 222/400.7 X |
| 3,752,362 | 8/1973 | Risener | 222/85 |
| 3,953,902 | 5/1976 | Taylor | 222/86 X |
| 4,152,378 | 5/1979 | Vcelka et al. | 222/541 X |
| 4,501,383 | 2/1985 | Iannelli | 222/82 |

FOREIGN PATENT DOCUMENTS

| | | | |
|---|---|---|---|
| 270134 | 8/1950 | Switzerland | 222/85 |
| 1446338 | 8/1976 | United Kingdom . | |

*Primary Examiner*—Joseph J. Rolla
*Assistant Examiner*—Michael S. Huppert
*Attorney, Agent, or Firm*—Polster, Polster & Lucchesi

[57] ABSTRACT

A closure for a disposable container is disclosed from which a liquid may be pressure dispensed. The container has a mouth and the closure comprises a closure body cooperable with the container mouth for closing the container mouth. The closure body is sealably secured with respect to the container mouth and a nipple is provided on the inner face of the closure body for operatively securing a dip tube thereto, with the dip tube extending into the liquid within the container. The nipple is centrally located with respect to the mouth. A first puncturable area is provided is provided on the closure body, blocking the outflow of liquid from the container via the dip tube, and a second puncturable area, located radially outwardly of the nipple is provided such that with a first puncturing tube puncturing the first puncturable area, and with a second puncturing tube puncturing the second puncturable area and being in communication with a source of compressed gas, the liquid within the container may be dispensed via the first puncturing tube.

4 Claims, 9 Drawing Figures

DISPENSING CONTAINER CLOSURE

CROSS REFERENCE TO A RELATED APPLICATION

This application is a continuation-in-part of U.S. patent application Ser. No. 487,561, filed Apr. 22, 1983, now U.S. Pat. No. 4,531,656; which is a continuation-in-part of U.S. patent application Ser. No. 439,115, filed Nov. 4, 1982; which is a continuation-in-part of U.S. patent application Ser. No. 363,511, filed Apr. 2, 1982, now U.S. Pat. No. 4,491,247; which is a continuation-in-part of U.S. patent application Ser. No. 285,611, filed Jul. 21, 1981, now U.S. Pat. No. 4,440,319.

BACKGROUND OF THE INVENTION

This invention relates to a closure for a disposable container from which a liquid may be pressure dispensed. Even more specifically, this invention relates to such a closure for a throw-away container in which the container is filled with liquid, delivered to an end user, installed within a dispensing apparatus, and internally pressurized for the pressurized dispensing bf the liquid within the container.

As described in the above-identified U.S. patent applications and patents, a system, apparatus, and method of pressure dispensing liquid from a disposable or throw-away container is disclosed wherein the liquid within the container is pressure dispensed. Such liquids may include a variety of beverages, such as soft drink syrups, but it may also include a variety of other liquids, including printing ink, insecticides, lubricating oils, edible oils, and the like.

In the parent application, U.S. patent application Ser. No. 487,561, a dispensing system, apparatus, and method of dispensing a liquid from a disposable container is disclosed. The container is a generally symmetrical bottle having a mouth located along the axial centerline of the container at the top thereof, and the mouth of the container is sealably closed by a closure. The dispensing apparatus includes a two-part shroud which telescopically fits together, with the lower part of the shroud receiving and holding a filled, sealed container of liquid to be dispensed. Upon telescopically fitting the upper portion of the shroud to the lower portion of the shroud, a puncturing tube carried by the upper portion of the shroud is brought into substantial axial alignment with the mouth of the container. Upon fully, telescopically assembling the shroud portions, the puncturing tube punctures the closure and opens communication between the puncturing tube and the interior of the theretofore hermetically sealed bottle. A dip tube is then inserted into the bottle via the puncturing tube, a removable portion of a stopper assembly is fitted in place, with this removable portion having a port and passage in register with the dip tube and leading to a "liquid out" coupling or fitting. The puncturing tube is also in communication with a gas port, which in turn was in communication with another fitting which could be readily coupled to a source of compressed gas (e.g., $CO_2$). With the container so fitted within the shroud, with the dip tube in place, and with the additional stopper portion in place, the container within the shroud is slid sideways into a frame which engaged the ends of the shroud so as to substantially prevent axial elongation of the container and shroud beyond a predetermined length. Upon pressurizing the interior of the container with compressed gas, an effective seal was made relatively to the dip tube and the puncturing tube and the liquid within the container is pressurized such that it could be effectively pressure dispensed via the dip tube and the "liquid out" fitting.

While the liquid dispensing system disclosed in U.S. patent application Ser. No. 487,561 worked well for its intended purpose, the preferred embodiment therein disclosed did require the use of a dip tube which was insertable into the container after the container was at least in part installed within the dispensing apparatus. Further, the dip tube, upon changing an empty container for a full container, must be removed from the empty container. This is a time-consuming and messy task inasmuch as the dip tube may well be covered with the liquid dispensed from the container.

While all of the prior art references cited in the above-identified co-pending applications and patents may be of interest, particular attention is drawn to British patent specification No. 1,446,338, which discloses a device for facilitating dispensing of liquid from plastic containers in which a stopper, including both a gas inlet tube and a dip tube, is fitting into the mouth of the container, and in which the container is surrounded by a containment so as to withstand internal pressure within the plastic container upon internal pressurization via the gas tube. Further, Riesener (U.S. Pat. No. 3,752,362) discloses a plastic container which is installable within a containment device, and which has a dip tube secured to the top of the container and extending down into the liquid. A portion of the container in register with the dip tube is puncturable by a first puncture tube, and another portion of the container is puncturable by a second puncturable tube. However, it is to be noted that the dispensing apparatus of the above-identified British patent requires a dip tube which must be lowered down into and removed from the liquid contents of the container, thus having the same disadvantages as heretofore described in regard to our prior U.S. patent application Ser. No. 487,561. While Riesener (U.S. Pat. No. 3,752,362) overcomes this problem by providing a dip tube in place within the container, Riesener discloses that the puncturing tubes for both the dip tube and the gas inlet be first aligned with their respective puncturable areas and then, upon threading the cap portion of the containment into place on a cylindrical containment body after puncturing the container, a "lazy susan" arrangement must be provided within the bottom of the containment which substantially supports the weight of the filled liquid container so as to freely permit the liquid container to be rotated within the cylindrical shroud housing as the cap is threaded onto the end thereof.

There has been a long-standing need for a pressure dispensing apparatus which would readily receive a sealed disposable container filled with a liquid to be dispensed, and yet which could be readily installed within a containment shroud or housing punctured, and pressurized, without the necessity of any orientation of the container with respect to the containment or with respect to the puncturing tubes. There has also been a long-standing need to provide such a container which does not require the use of puncturing grommets or the like.

SUMMARY OF THE INVENTION

Among the several objects and features of the present invention may be noted the provision of a closure for a disposable container which may be readily, sealably applied to the container and which remains sealably applied to the container even during pressure dispensing of the liquid contents from within the container;

The provision of such a container which incorporates a dip tube fixedly attached thereto in dispensing relation with the liquid within the container;

The provision of such a closure which, when the container is installed in a containment shroud, does not require orientation of the container with respect to the containment so as to permit puncturing of the closure for communication with the dip tube and for permitting internal pressurization of the container;

The provision of such a closure which self-seals relative to a containment shroud or a portion thereof upon internal pressurization of the container; and The provision of such a closure which is of economical and rugged construction, which may be readily and economically manufactured, which may readily have a dip tube sealably affixed thereto, which may be readily applied and sealed with respect to the container, and which will maintain the contents of the container in a sealed, sanitary condition for an extended period of time and during transport of the container.

Other objects and features of this invention will be in part apparent and in part pointed out hereinafter.

Briefly stated, a closure of this invention for a disposable container from which a liquid may be pressure dispensed is disclosed. The container has a mouth, and the closure comprises a closure body cooperable with the container mouth for closing the latter. Means is provided for sealably securing the closure body with respect to the container mouth. Nipple means is provided on the inner face of the closure body for operatively securing a dip tube thereto, with the dip tube extending down into the liquid contained within the container. The nipple is centrally located with respect to the container mouth. A first puncturable area is provided on the closure body blocking the outflow of liquid via the dip tube. A second puncturable area of the closure body is located radially outwardly of the nipple such that with a first puncturing tube puncturing said first puncturable area, and with a second puncturing tube puncturing the second puncturable area and being in communication with a source of compressed gas, the liquid within the container is dispensed via the first puncturing tube.

BRIEF DESCRIPTION OF THE DRAWINGS

Corresponding reference characters indicate corresponding parts throughout the several views of the drawings.

DESCRIPTION OF A PREFERRED EMBODIMENT

This invention is an improvement for the container shown in our prior U.S. patent application Ser. No. 487,561, filed Apr. 22, 1983. This last-mentioned U.S. patent application, together with the other applications and patents cited in the above-noted "Cross Reference To Related Applications", are herein incorporated by reference.

Figure 3:
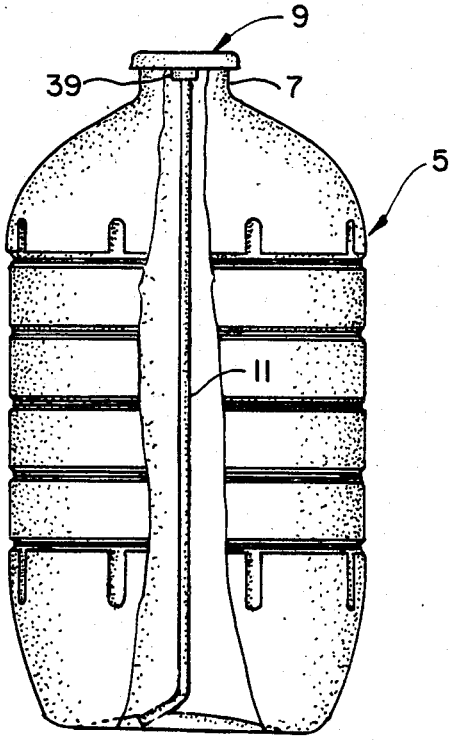
FIG. 3 is a view of a disposable plastic bottle, having the closure of this invention sealably fitted to the mouth thereof, with the bottle broken away so as to illustrate a dip tube within the bottle.
Figure 4:
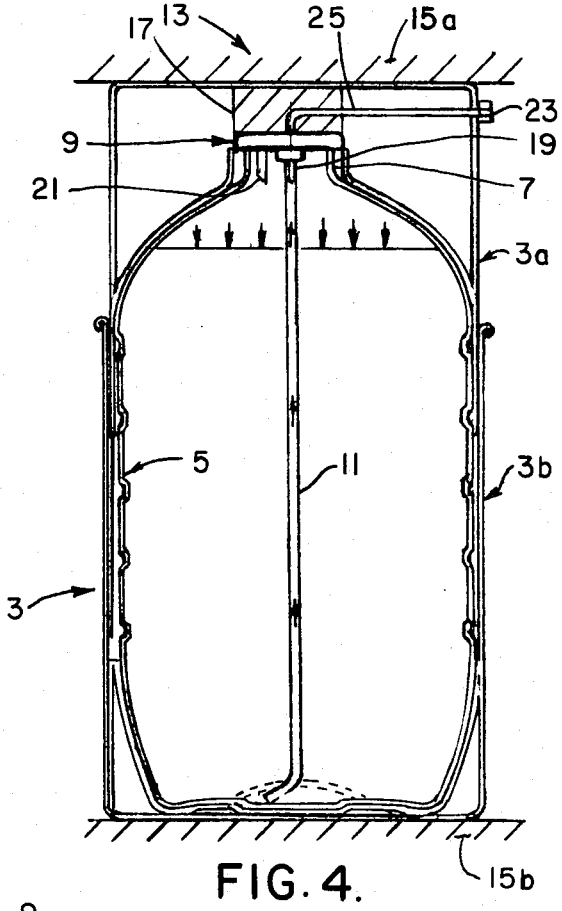
FIG. 4 is a semi-diagrammatic view of the container of FIG. 3 contained within the shroud as shown in FIGS. 1 and 2, and with the shroud fitted within the frame so as to prevent axial elongation of the telescopic shroud upon internal pressurization of the container for pressure dispensing of liquid from within the container via the dip tube.

More specifically, this invention relates to a system for pressure dispensing a liquid, as is generally indicated in its entirety by reference character 1. The now preferred embodiment of the present invention is illustrated in FIGS. 1–4 of the present application, and is shown to comprise a so-called telescopic shroud, as generally indicated at 3, comprising a top shroud portion 3*a*, which telescopically fits into a lower or bottom shroud portion 3*b*. A container, as generally indicated at 5, and is heretofore disclosed in U.S. patent application Ser. No. 487,561, is received within the upper and lower shroud portions such that substantially all of the outer portions of the container are supported by corresponding structure within the shroud 3, as is shown in FIG. 4, such that the container 5 is supported by the shroud 3 when the container is internally pressurized. In this manner, container 5 need not be capable of withstanding the internal pressure forces applied thereto. Instead, shroud 3 carries substantially all of the circumferential pressure loading on container 3.

Figure 2:
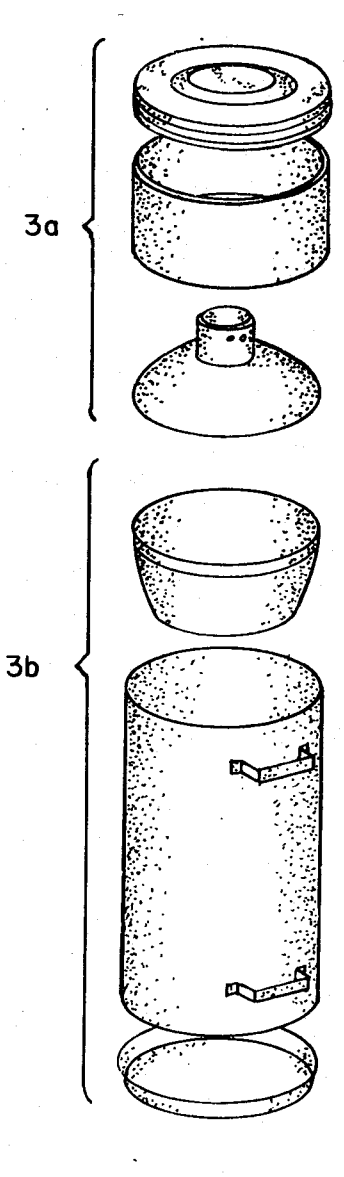
FIG. 2 is an exploded view of the various major parts constituting the two-part telescopic shroud shown in FIG. 1.
Figure 1:
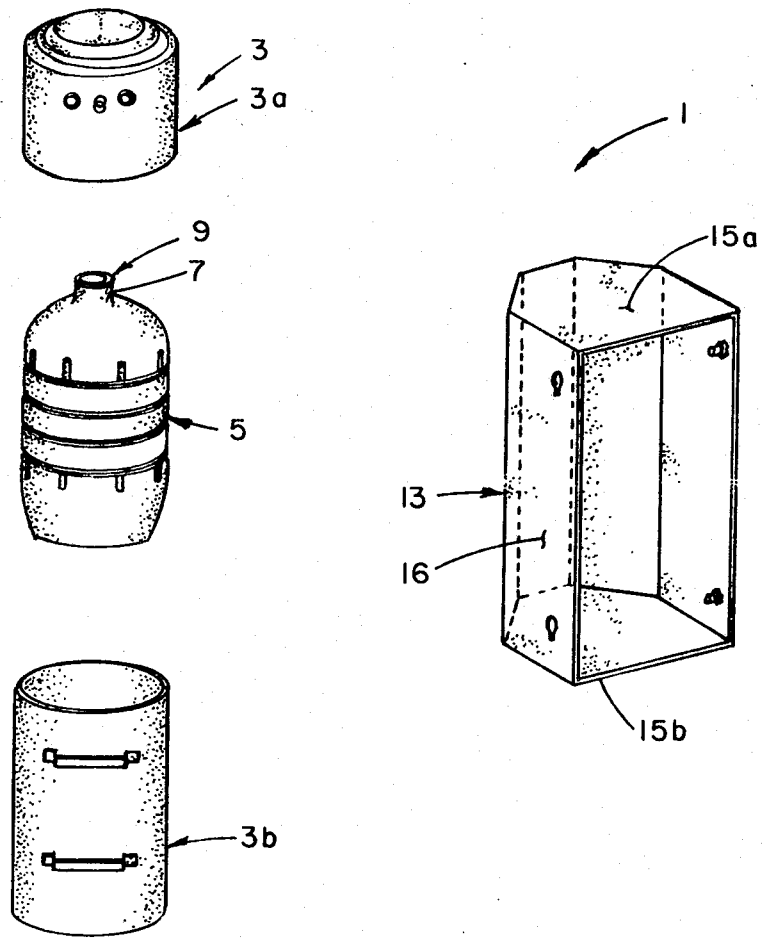
FIG. 1 is an exploded view of a pressure dispensing system of the present invention, including a two-part, telescopic shroud encasing a disposable container having a closure of the present invention fitted thereto, with the pressure dispensing apparatus further including a frame into which the assembled shroud with the container therewithin is fitted, with the frame preventing axial movement of the telescopic shroud parts upon internal pressurization of the container.

As shown in FIG. 1, container 5 has a central neck 7 which is sealably closed by means of a closure 9 of the present invention. A dip tube 11 is operatively connected to closure 9 in a method as will appear for pressure dispensing of liquid from within the container 5 in a manner as will be hereinafter described.

Further, pressure dispensing system 1 includes a so-called frame, as generally indicated at 13, having upper and lower spaced-apart end walls 15*a*, 15*b* which are securely joined together by means of sheet metal walls or the like 16 extending therebetween. End walls 15*a*, 15*b* are spaced apart a distance sufficient such that with container 5 installed within shroud 3, the shroud together with the container therein may be readily slid into the open front of frame 13. Upon internal pressurization of container 5, as shown in FIG. 4, the upper and lower telescopic shroud portions 3*a*, 3*b* will tend to move axially away from one another upon initial pressurization of the container, and upon the push-up bottom of the container (as shown in FIG. 3), snapping over center from an unpressurized concave position (as shown in FIG. 3) to an outwardly extending convex position (as shown in FIG. 4). In this manner, as was heretofore described, the shroud 3 carries substantially all of the circumferential loading applied by the internal pressure within container 5 and frame 13 positively prevents axial movement of the telescopic shroud portions beyond a predetermine amount, and thus carries substantially all of the axial or longitudinal pressure loading of the container. In this manner, the container is substantially totally enclosed and supported by the shroud, and all of the pressure forces exerted on the bottle, both circumferential and longitudinal loading, are borne by the shroud and by the frame. It will be understood that substantial axial loading is withstood by frame 13, and the frictional force of the ends of shroud portions 3*a*, 3*b* bearing on end plates 15*a*, 15*b* effectively prevents removal of the shroud from within the frame so long as any substantial amount of pressure (e.g., about 1 psi or more) remains within container 5. As shown in FIG. 4, upper shroud portion 3*a* includes a support 17 having a first puncturing tube 19 and a second puncturing tube 21, with the first puncturing tube being located substantially coaxially with respect to shroud portion 3*a*, and with respect to mouth 7 of container 5 when the container is received within the shroud. The first puncture tube or liquid out puncture tube 19 is in communication with a suitable quick disconnect fitting 23 by means of a liquid line 25. Likewise, the second puncturing tube 21 is connected to another similar quick disconnect fitting (not shown) by a suitable line such that the second puncturing tube 21 may be selectively connected to a source of compressed gas, such as $CO_2$ or the like.

Figure 5:
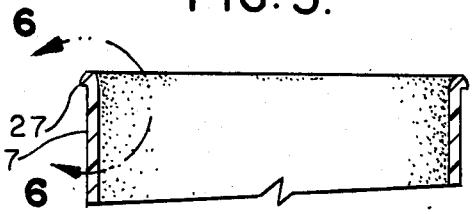
FIG. 5 is an enlarged view of the neck of the container.
Figure 6:
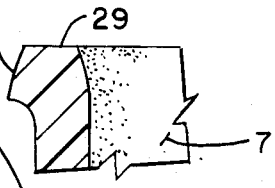
FIG. 6 is an enlarged view of a portion of the neck, taken along line 6—6 of FIG. 5, illustrating a shoulder provided on the neck, and illustrating a flat upper surface on the neck.

Referring now to FIGS. 3, 5, and 6, container 5 is shown to be a blow-molded container of a suitable synthetic resin material, such as high density polyethylene or the like. Container 5 has a centrally located neck 7, having a flange 27 at the upper end thereof which constitutes the mouth of the container. As best shown in FIG. 6, the upper surface 29 of the container mouth is a flat planar surface. Details of construction of bottle 5 may be had by referring to the above-noted U.S. patent application Ser. No. 487,561, which is herein incorporated by reference.

Figure 7:
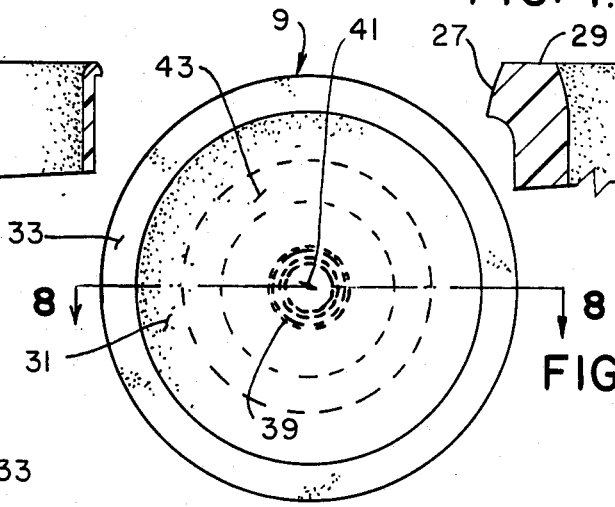
FIG. 7 is a top plan view of the closure of the present invention, illustrating a closure body and a crimping ring for sealably securing the closure body on the mouth of the container.
Figure 8:
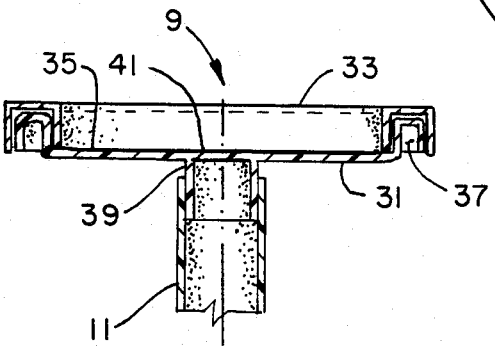
FIG. 8 is a cross sectional view of the closure, taken along line 8—8 of FIG. 7, illustrating the closure body, a centrally-located nipple on the inner face of the closure body, a crimping ring, and a dip tube sealably fitted onto the nipple.
Figure 9:
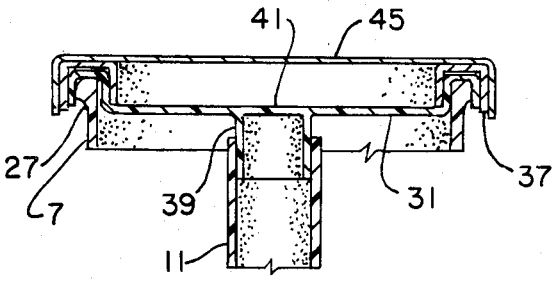
FIG. 9 is a view similar to FIG. 8, showing the closure sealably secured or crimped onto the mouth of the container, and further showing a removable sanitary cover fitted over the closure for protecting the closure from dirt and for maintaining the closure in a sanitary condition prior to use.

Referring now to FIGS. 7–9, closure 9 of the present invention is shown to comprise a closure body 31 which is adapted to fit on and to sealably close the mouth of container 5. A metal crimping ring 33 or other suitable means is provided for securely, sealably securing closure body 31 to the mouth of container 3. As is best shown in FIGS. 8 and 9, closure body 31 is molded of a suitable synthetic resin material, such as low density polyethylene, and has a generally planar central portion 35 and an annular channel portion 37 adapted to be received on flange 27 of bottle mouth 7. Crimping ring 33 is commercially available from the American Flange & Manufacturing Co., Inc., of Linden, New Jersey, under the registered trademark UNI-GRIP. It will be understood that conventional tools are commercially available from American Flange for crimping ring 33, together with the channel-shaped portion 37 of closure body 31 into tight, sealing engagement with flange 27 on bottle neck 7, in the manner as shown in FIG. 9, such that the closure 9 is positively sealed relative to the bottle neck thereby to hermetically seal the liquid contents of the bottle therewithin, and to withstand changes in pressure within the container due to shipping forces, due to dropping of the container from heights as may be normally experienced during transport and use of the container, and during warehousing or other storage of the container.

As indicated at 39, a nipple is integrally molded-in-place on the inner or bottom face of closure body 31 so as to be substantially coaxial with the closure body 31. As shown in FIGS. 8 and 9, dip tube 11 is fixedly, sealably secured to nipple 37. This may be accomplished by a simple mechanical sliding, sealing fit of the dip tube onto the nipple. Such a sealing fit between the nipple and the dip tube may also be accomplished by heat shrinking the dip tube onto the nipple, or by adhesively bonding or ultrasonically welding the dip tube to the nipple. Those skilled in the art will recognize that, within the broader aspects of this invention, the particular manner of sealably securing the dip tube to nipple 37 does not, per se, constitute a basic feature of the present invention. Preferably, the internal diameter of nipple 39 is somewhat larger than the outer diameter of the puncturing tube 19 so as to accommodate dimensional variations and misalignment between the puncturing tube and the position of the container within the shroud.

As indicated at 41, a portion of closure body 31 is integrally molded with the closure body and closes off nipple 37 such that with dip tube 11 in place, and with closure 9 secured to the mouth of the bottle, as shown in FIG. 3, liquid within the bottle is positively prevented from being discharged from the container via the dip tube. This central portion 41 of closure body is referred to as a first puncturable area. It will be understood with container 3 received in shroud 3, as shown in FIG. 4, the first puncturable area 41 is in substantial coaxial alignment with respect to shroud 3, and with first puncturing tube 19.

A second puncturable area, as indicated at 43 in FIG. 7, is also provided on closure body 31, located radially outwardly from the first puncturable area 41. In accordance with this invention, the second puncturable area 43 is an annular area of closure body 31 located radially outwardly from the first puncturable area, and it will be understood that it is intended that this second puncturable area be punctured by the second puncturing tube 21 when container 3 is installed within the lower shroud portion 3*b*, and when the upper shroud portion is telescopically received therewithin, and forced downwardly such that the puncturing tubes 19 and 21 puncture through their respective puncturing areas 41 and 43. It will be understood that when the first or liquid puncturing tube 19 punctures through the first puncture area 41, communication is opened between the puncturing tube and the interior of nipple 39 and dip tube 11. Likewise, when the second puncturing tube 19 punctures through the second puncturable area 43 of the closure, communication is established between the interior of container 5 and the puncturing tube. Thus, with puncturing tube 21 in communication with a source of compressed gas, gas will flow into the interior of container 3, pressurize the liquid contents of the container, and forceably dispense liquid from within the container via dip tube 11, liquid dispensing tube 25, and quick disconnect fitting 23.

As best shown in FIG. 4, the ends of puncturing tubes 19 and 21 are beveled. It has been found that by beveling the tips of these tubes at approximately a 45–60 degree angle, with respect to the longitudinal axis of the tubes, that when the puncturing tubes puncture their respective areas, the wafer of synthetic resin material pierced by the puncturing tubes remains attached to closure body 31 such that the wafer cut from the closure body does not drop into either the dip tube or the container. In this manner, it is not possible that a piece of the closure body 31 will become lodged in the dip tube or in the quick connect fitting 23, thus preventing full dispensing of the liquid contents of container 3. As is shown in FIG. 4, support 17 has a portion (not shown) which extends down below crimp ring 33 and engages the upper surface of closure body 31 so as to prevent substantial axial outward movement of the closure body 31 upon internal pressurization of container 3. In this manner, the closure body 31 will seal tightly against the puncturing tubes 19 and 21, and the internal pressure forces within container 3 will effectively seal the puncturing openings formed in closure body 31 within the first and second puncturing areas 41 and 43. Thus, the closure body 31 serves a double function of not only a closure body, but also serves as a self-sealing gasket which is replaced each time a new bottle is utilized.

As shown in FIG. 9, a removable protective cover 45 may be secured in place over closure crimp ring 37 and over closure body 31 to maintain the upper surfaces of closure body 31 in a sanitary condition after filling and during transport and storage of container 3.

In use, the container 5 is filled with a suitable liquid (e.g., soft drink post-mix syrup or the like) via mouth 7. Immediately after filling, closure 9, with dip tube 11 secured to nipple 39, is placed on the mouth of the container and crimping ring 33 is crimped-in-place so as to sealably secure closure body 31 on flange 27 of container neck 7. Protective cover 45 may be applied simultaneously with the crimping ring, or may be applied in a secondary operation. The filled bottle is then transported to its end use location. Upon use, the bottle with the closure and preferably with cover 45 in place, is inserted into the bottom portion **3*b* of shroud 3. The protective cover 45 is removed, thus exposing the still sanitary surfaces of closure body 31. The upper shroud body 3*a* is telescopically fitted in place within shroud body 3*b*, and the shroud portions are telescopically moved toward one another. It will be appreciated that regardless of the angular orientation of container 5 within shroud 3, the first or liquid puncturing tube 19 is generally aligned with the first puncturable area 41 of closure body 39, and the second or gas puncture tube 21 will be in register with at least one portion of the annular second puncturable area 43, located radially outwardly from the center of the closure. As the shroud portions 3*a* and 3*b* are telescopically brought together, the puncturing tubes 19 and 21 will puncture their respective puncturing areas, thus opening communication between liquid line 25 and dip tube 11, and permitting compressed gas (e.g., $CO_2$) to enter container 3 via the second puncturing tube 21** when the second puncturing tube is connected to a source of the compressed gas.

However, before pressurization of the container 3 with compressed gas via puncturing tube 21, shroud 3, with container 5 therein, is slid into frame 13. Then, upon connecting puncturing tube 21 to a suitable source of compressed gas, the compressed gas will flow into the interior of container 5 so as to internally pressurize the container. The container will initially grow in axial direction, thus effecting self-sealing of closure body 31 with respect to puncturing tubes 19 and 21, and with respect to the portion of support 17 in face-to-face engagement with closure body 31. Once the ends of shroud 3 bear firmly against end walls **15*a*, 15*b* of frame 13, the frame will carry substantially all of the longitudinal pressure forces exerted on the bottle, and shroud 3** will carry substantially all of the circumferential loads imposed on the bottle upon internal pressurization thereof.

It will be particularly noted that with the dip tube located on the central nipple 39, and with the second puncturing tube 21 being able to puncture any portion of the second annular puncturable area 43, container 5 need not, in any way, be angularly oriented with respect to shroud 3 so as to permit puncturing of pre-selected areas of the closure.

Of course, for removal of an empty container 5 from within, the apparatus 1, a liquid discharge line (not shown) is disconnected from quick disconnect 23, and the source of compressed gas is also removed. Then, preferably a suitable combination safety release and vent valve (not shown) in communication with gas puncturing tube 21, is opened thereby to permit the gas pressure from within container 3 to be vented to the atmosphere. Upon de-pressurization of container 5, shroud 3 may be slid out of frame 13 and the shroud can be telescopically disassembled, thus permitting the empty bottle to be removed. A full bottle may be inserted into the bottom shroud fixture, its cover 45 removed, and the top shroud portion **3*a* telescopically reinserted thereby automatically aligning the puncturing tubes 19 and 21 with their respective puncturable areas 41 and 43** of the new bottle and permitting proper puncturing of the new bottle.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In a pressurized liquid dispensing system comprising a container having a mouth, said container being of a suitable synthetic resin and being incapable of withstanding internal pressurization forces necessary for pressure dispensing of said liquid, means receiving said container for withstanding axial and circumferential pressure forces exerted on said container upon internal pressurization thereof, said pressure withstanding means comprising a shroud body receiving at least a portion of said container, a shroud top telescopically received by said shroud body, and means for securing said shroud body and shroud top together so that said shroud body and shroud top withstands circumferential pressure forces and said securing means withstands axial pressure forces, said shroud top having a first puncturing tube disposed along the axial centerline of said shroud top through which liquid from within said container may be dispensed, and a second puncturing tube located radially outwardly from said first puncturing tube which may be selectively connected to a source of compressed gas, wherein the improvement comprises: a closure for closing said mouth of said container, means for sealably securing said closure to said mouth, a dip tube operatively associated with said closure, said dip tube being located generally at the center of said closure, said closure having a first puncturable area at the center of said closure in register with said dip tube for closing said dip tube and a second puncturable area located radially outwardly from said dip tube and extending circumferentially around said first puncturable area such that with said container received within said shroud body and with said shroud top telescopically applied to said shroud body, said first puncturing tube is in axial register with said first puncturable area and said second puncturing tube is in register with said puncturable area without the necessity of rotatably aligning said container and said shroud top relative to one another such that upon inward axial movement of said shroud top with respect to said shroud body said first puncturing tube punctures said first puncturable area thereby to open communication with said dip tube and said first puncturing tube and said second puncturing tube punctures said second puncturable area at any circumferential position therearound in register with said second puncturing tube thereby to admit said compressed gas into said container for the pressurized dispensing of said liquid via said dip tube.

2. In a pressurized dispensing system as set forth in claim 1 wherein said puncturing tubes self-seal with respect to said closure as said puncturing tubes puncture therethrough.

3. In a pressurized liquid dispensing system as set forth in claim 1 wherein said closure is of a flexible synthetic resin material which serves as a sealing gasket for said puncturing tubes.

4. A pressurized liquid dispensing system comprising a container having a mouth, said container being of a suitable synthetic resin and being incapable of withstanding internal pressurization forces necessary for pressure dispensing of said liquid, means receiving said container for withstanding pressure forces exerted on said container upon internal pressurization thereof, said pressure withstanding means comprising a shroud body receiving at least a portion of said container and a shroud top telescopically received by said shroud body, and means for securing said shroud body and shroud top together so that said shroud body and shroud top withstand circumferential pressure forces and said securing means withstands axial pressure forces, said shroud top having a first puncturing tube dipsosed along the axial centerline of said shroud top through which liquid from within said container may be dispensed, and a second puncturing tube located radially outwardly from said first puncturing tube which may be selectively connected to a source of compressed gas, a closure for closing said mouth of said container, said closure having a closure body of flexible sheet synthetic resin material, means for sealably securing said closure to said mouth, a dip tube operatively associated with said closure, said dip tube being located generally at the center of said closure, said closure having a first puncturable area at the center of said closure in register with said dip tube for closing said dip tube and a second puncturable are located radially outwardly from said dip tube and extending circumferentially around said first puncturable area such that with said container received within said shroud body and with said shroud top telescopically applied to said shroud body, said first puncturing tube is in substantial axial alignment with said first puncturable area and said second puncturing tube is in register with said second puncturable area without the necessity of rotatably aligning said container and said shroud top relative to one another such that upon inward axial movement of said shroud top with respect to said shroud body said first puncturing tube punctures said first puncturable area thereby to open communication with said dip tube and said first puncturing tube and said second puncturing tube punctures said second puncturable area at any circumferential position therearound in register with said second puncturing tube thereby to puncture said second puncturable and to admit said compressed gas into said container for internally pressurizing said container, for effecting axial elongation of said container and axial outward movement of said closure body thereby to result in self-sealing of said puncturing tubes and said closure body relative to one another, and for the pressurized dispensing of said liquid via said dip tube.

* * * * *